US010081183B2

(12) United States Patent
Ikeuchi et al.

(10) Patent No.: US 10,081,183 B2
(45) **Date of Patent: *Sep. 25, 2018**

(54) CHANNEL MEMBER FOR LIQUID EJECTING HEAD, LIQUID EJECTING HEAD INCLUDING THE SAME, AND RECORDING DEVICE INCLUDING THE SAME

(71) Applicant: Kyocera Corporation, Kyoto-shi, Kyoto (JP)

(72) Inventors: Wataru Ikeuchi, Kirishima (JP); Chisako Fukuda, Ikeda (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/630,120

(22) Filed: Jun. 22, 2017

(65) Prior Publication Data

US 2017/0361612 A1 Dec. 21, 2017

Related U.S. Application Data

(63) Continuation of application No. 15/114,707, filed as application No. PCT/JP2015/074550 on Aug. 29, 2015, now Pat. No. 9,688,070.

(30) Foreign Application Priority Data

Feb. 24, 2015 (JP) ..... 2015-034136

(51) Int. Cl.
*B41J 2/165* (2006.01)
*B41J 2/14* (2006.01)

(52) U.S. Cl.
CPC ..... *B41J 2/1433* (2013.01); *B41J 2/14* (2013.01)

(58) Field of Classification Search
None
See application file for complete search history.

(56) References Cited

U.S. PATENT DOCUMENTS

| | | | | |
|---|---|---|---|---|
| 9,688,070 | B2 * | 6/2017 | Ikeuchi | B41J 2/14 |
| 2009/0231391 | A1 | 9/2009 | Akahane | |
| 2015/0224766 | A1 | 8/2015 | Kawamura et al. | |

FOREIGN PATENT DOCUMENTS

| | | | |
|---|---|---|---|
| EP | 1403053 | A1 | 3/2004 |
| JP | 07-144410 | A | 6/1995 |

(Continued)

OTHER PUBLICATIONS

International Search Report (Form PCT/ISA/210) dated Oct. 13, 2015 and issued for PCT/JP2015/074550.

(Continued)

*Primary Examiner* — Alejandro Valencia
(74) *Attorney, Agent, or Firm* — Volpe and Koenig, P.C.

(57) ABSTRACT

A channel member for a liquid ejecting head according to the present invention includes plates that are stacked together. The plates include a first plate including a first hole, a second plate including a second hole, and a third plate including a third hole. In plan view, an opening at the bottom side of the first hole and an opening at the top side of the third hole have a region in which the openings and overlap and a region in which the openings and do not overlap, and the opening at the bottom side of the first hole and the opening at the top side of the third hole are inside the second hole.

3 Claims, 6 Drawing Sheets

(56) References Cited

FOREIGN PATENT DOCUMENTS

| | | | |
|---|---|---|---|
| JP | 2002-036545 | A | 2/2002 |
| JP | 2003-311955 | A | 11/2003 |
| JP | 2004-122680 | A | 4/2004 |
| WO | 2014/034892 | A1 | 3/2014 |

OTHER PUBLICATIONS

Extended European Search Report, European Application No. 15883295.
6, dated Oct. 30, 2017, 9 pgs.

* cited by examiner

CHANNEL MEMBER FOR LIQUID EJECTING HEAD, LIQUID EJECTING HEAD INCLUDING THE SAME, AND RECORDING DEVICE INCLUDING THE SAME

TECHNICAL FIELD

The present invention relates to a channel member for a liquid ejecting head, a liquid ejecting head including the channel member, and a recording device including the channel member.

BACKGROUND ART

A known example of a liquid ejecting head is an inkjet head that performs various types of printing by ejecting liquid toward a recording medium. A liquid ejecting head includes a channel member, which includes a plurality of ejection holes and a plurality of compression chambers, and a piezoelectric actuator substrate, which includes displacement elements that compress liquid in the compression chambers. The channel member includes a plurality of plates that are stacked together, the plates including holes that constitute channels. The ejection holes are provided on one principal surface of the channel member, and the compression chambers are provided on the other principal surface of the channel member. The channel member includes channels that connect the ejection holes to the compression chambers (see, for example, PTL 1).

CITATION LIST

Patent Literature

PTL 1: Japanese Unexamined Patent Application Publication No. 2003-311955

SUMMARY OF INVENTION

Technical Problem

In the liquid ejecting head described in PTL 1, the channels connecting the ejection holes to the compression chambers may be slightly inclined relative to a stacking direction in which the plates are stacked. In such a case, when the holes in the plates are displaced due to, for example, variations in the manufacturing process, the channel characteristics, such as the channel resistance, are changed in different ways depending on the directions of the displacements. Accordingly, the ejection characteristics, such as the ejection speed and the amount of ejection of the liquid, may greatly vary depending on the directions of the displacements.

Accordingly, an object of the present invention is to provide a channel member for a liquid ejecting head, a liquid ejecting head including the channel member, and a recording device including the channel member with which variations in ejection characteristics caused when holes in plates that constitute channels are displaced are small.

Solution to Problem

A channel member for a liquid ejecting head according to an embodiment of the present invention is a channel member for a liquid ejecting head including a channel that includes a partial channel. The channel member includes a plurality of plates that are stacked together, the plurality of plates including a first plate, a second plate, and a third plate that are successively stacked together. The first plate includes a first hole that extends through the first plate and constitutes a portion of the partial channel. The second plate includes a second hole that extends through the second plate and constitutes a portion of the partial channel. The third plate includes a third hole that extends through the third plate and constitutes a portion of the partial channel. In plan view of the channel member, an opening of the first hole at a side adjacent to the second plate and an opening of the third hole at a side adjacent to the second plate include a region in which the opening of the first hole at the side adjacent to the second plate and the opening of the third hole at the side adjacent to the second plate overlap and a region in which the opening of the first hole at the side adjacent to the second plate and the opening of the third hole at the side adjacent to the second plate do not overlap, and the opening of the first hole at the side adjacent to the second plate and the opening of the third hole at the side adjacent to the second plate are inside the second hole.

A liquid ejecting head according to an embodiment of the present invention includes the channel member for a liquid ejecting head, and a compressing portion that compresses liquid in the channel.

A recording device according to an embodiment of the present invention includes the liquid ejecting head, a conveying unit that conveys a recording medium relative to the liquid ejecting head, and a control unit that controls the liquid ejecting head.

Advantageous Effects of Invention

With a liquid ejecting head including a channel member for a liquid ejecting head according to an aspect of the present invention, even when holes constituting partial channels are displaced, variations in liquid ejection characteristics can be reduced.

DESCRIPTION OF EMBODIMENTS

Figure 1A:
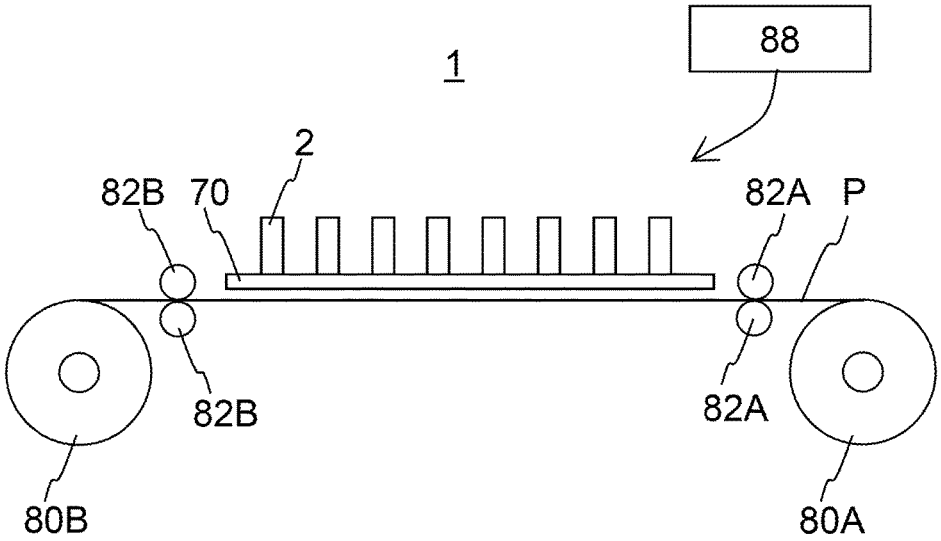
FIGS. 1(*a*) and 1(*b*) are a side view and a plan view, respectively, of a recording device including liquid ejecting heads according to an embodiment of the present invention.
Figure 1B:
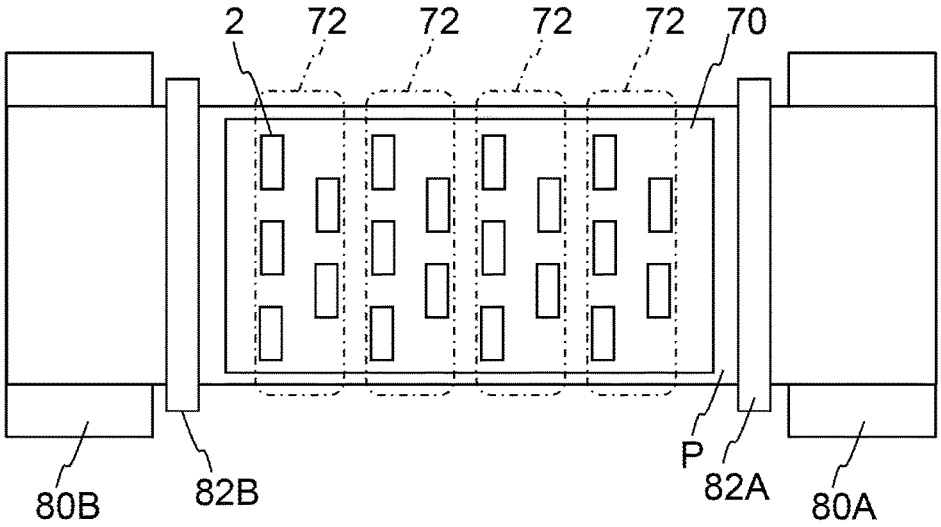

FIGS. 1(*a*) and 1(*b*) are a schematic side view and a schematic plan view, respectively, of a color inkjet printer 1 (hereinafter sometimes referred to simply as a printer), which is a recording device including liquid ejecting heads 2 according to an embodiment of the present invention. The printer 1 moves a print sheet P, which is a recording medium, relative to the liquid ejecting heads 2 by conveying the print sheet P from guide rollers 82A to conveying rollers 828. A control unit 88 controls the liquid ejecting heads 2 on the basis of image and character data so that the liquid ejecting heads 2 eject liquid toward the recording medium P. Recording, such as printing, is performed on the print sheet P by applying liquid droplets to the print sheet P.

In the present embodiment, the liquid ejecting heads 2 are fixed to the printer 1. The printer 1 is a line printer. A recording device according to another embodiment of the present invention may be a serial printer in which an operation of moving the liquid ejecting heads 2 in a direction that crosses a conveying direction of the print sheet P, for example, in a direction substantially perpendicular to the conveying direction, and an operation of conveying the print sheet P are alternately performed.

A flat plate-shaped head mounting frame 70 (hereinafter sometimes referred to simply as a frame) is fixed to the printer 1 such that the frame 70 is substantially parallel to the print sheet P. The frame 70 has twenty holes (not shown), and twenty liquid ejecting heads 2 are placed in the holes in such a manner that portions of the liquid ejecting heads 2 from which the liquid is ejected face the print sheet P. The distance from the liquid ejecting heads 2 to the print sheet P is, for example, about 0.5 to 20 mm. Every five liquid ejecting heads 2 form a single head group 72; accordingly, the printer 1 includes four head groups 72.

The liquid ejecting heads 2 have a long and narrow shape that extends in a direction from the near side toward the far side in FIG. 1(*a*), which is a vertical direction in FIG. 1(*b*). The direction in which the liquid ejecting heads 2 extend may be referred to as a long-side direction. In each head group 72, three liquid ejecting heads 2 are arranged in a direction that crosses the conveying direction of the print sheet P, for example, in a direction substantially perpendicular to the conveying direction. The remaining two liquid ejecting heads 2 are arranged at locations shifted from the three liquid ejecting heads 2 in the conveying direction, and each of the two liquid ejecting heads 2 is disposed between the three liquid ejecting heads 2. The liquid ejecting heads 2 are arranged such that printable areas thereof are connected to each other, or overlap at the ends, in the width direction of the print sheet P (direction that crosses the conveying direction of the print sheet P). Thus, an image that is continuous in the width direction of the print sheet P can be printed.

The four head groups 72 are arranged in the conveying direction of the recording sheet P. Each liquid ejecting head 2 receives liquid, for example, ink, from a liquid tank (not shown). The liquid ejecting heads 2 belonging to each head group 72 receive ink of the same color, so that the four head groups 72 are capable of performing printing by using inks of four colors. The colors of inks ejected from the head groups 72 are, for example, magenta (M), yellow (Y), cyan (C), and black (K). Color image printing can be performed by using these inks under the control of the control unit 88.

If monochrome printing is to be performed over an area within a printable area of a single liquid ejecting head 2, the number of liquid ejecting heads 2 to be mounted on the printer 1 may be one. The number of liquid ejecting heads 2 belonging to each head group 72 and the number of head groups 72 may be changed as appropriate depending on the printing subject and printing conditions. For example, the number of head groups 72 may be increased to increase the number of colors that can be printed. When a plurality of head groups 72 that perform printing in the same color are provided and caused to perform printing alternately in the conveying direction, the conveying speed can be increased without changing the performance of the liquid ejecting heads 2. In this case, the print area per unit time can be increased. Alternatively, a plurality of head groups 72 that perform printing in the same color may be arranged at locations shifted from each other in a direction that crosses the conveying direction to increase the resolution in the width direction of the print sheet P.

Instead of performing printing by using colored ink, surface treatment for the print sheet P may be performed by applying liquid such as a coating agent to the print sheet P.

The printer 1 prints on the print sheet P, which is a recording medium. The print sheet P is wound around a feed roller 80*a*. The print sheet P passes through the space between the two guide rollers 82A, the space below the liquid ejecting heads 2 mounted on the frame 70, and the space between the two conveying rollers 82B, and is finally wound around a take-up roller 80*b*. In a printing operation, the conveying rollers 82B are rotated so that the print sheet P is conveyed at a constant speed, and the liquid ejecting heads 2 performs printing. The print sheet P conveyed by the conveying rollers 82B is wound around the take-up roller 80*b*. The conveying speed is, for example, 75 m/min. Each roller may be controlled either by the control unit BB or manually by a user.

The recording medium may be a roll of cloth instead of the print sheet P. The printer 1 may convey the recording medium by placing the recording medium on a conveying belt and directly moving the conveying belt instead of directly conveying the print sheet P. In this case, a cut sheet, a cut piece of cloth, a wood piece, a tile, etc., may be used as the recording medium. The liquid ejecting heads 2 may eject liquid containing conductive powder to print, for example, a wiring pattern of an electronic device. Alternatively, the liquid ejecting heads 2 may eject a predetermined amount of liquid chemical agent or liquid containing a chemical agent toward a reaction chamber to create a reaction for producing a chemical.

Position sensors, speed sensors, temperature sensors, etc., may be attached to the printer 1. The control unit 88 may control each part of the printer 1 in accordance with the states of the parts of the printer 1 that can be determined from information obtained by the sensors. For example, when the temperature of the liquid ejecting heads 2, the temperature of the liquid in the liquid tank, and the pressure applied to the liquid ejecting heads 2 by the liquid in the liquid tank affect the ejection characteristics (such as the amount of liquid that is ejected and the ejection speed), driving signals used to eject the liquid may be changed in accordance with these pieces of information.

Figure 2:
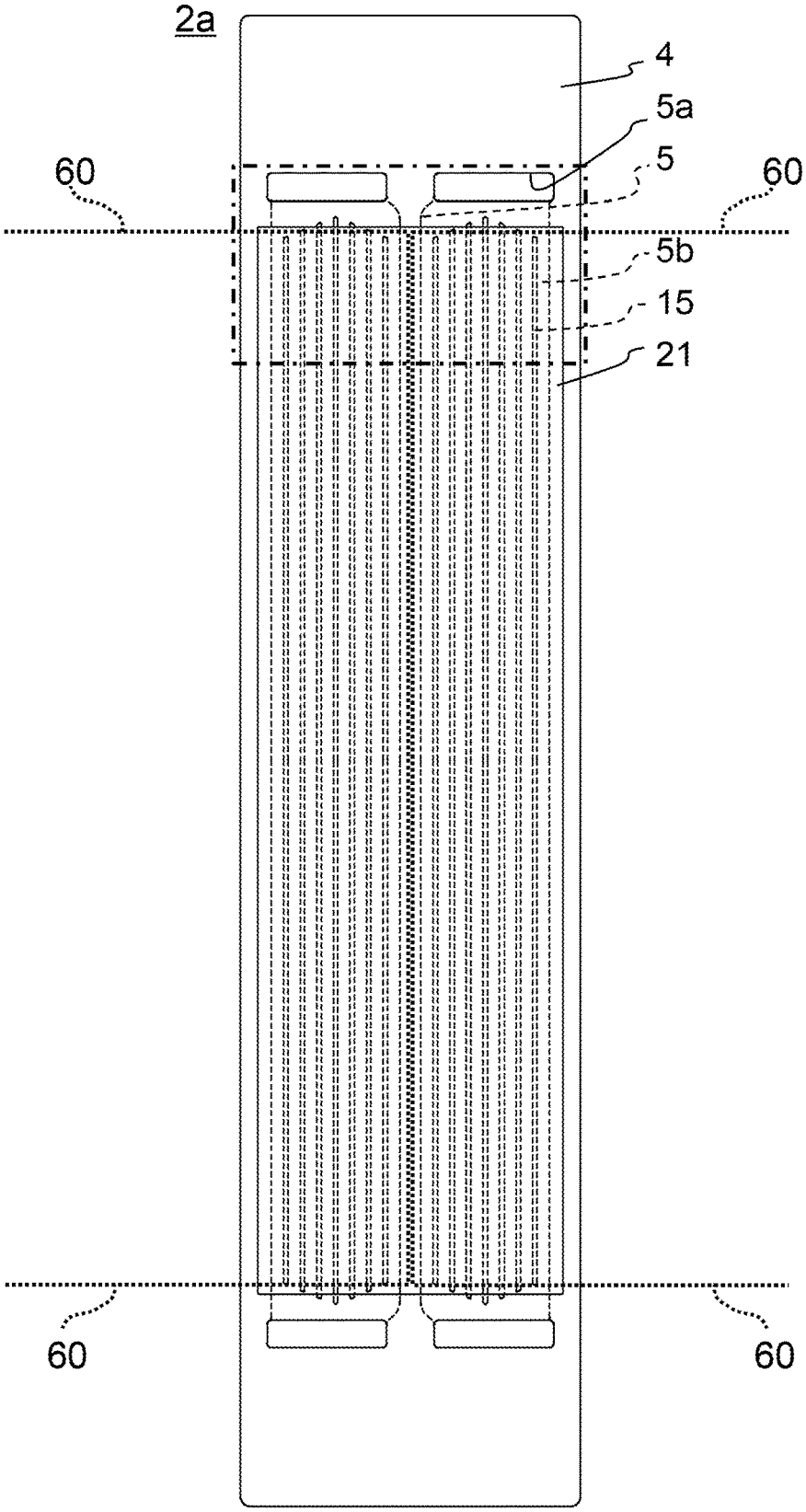
FIG. 2 is a plan view of a head body, which is a main portion of each liquid ejecting head in FIG. 1.
Figure 3:
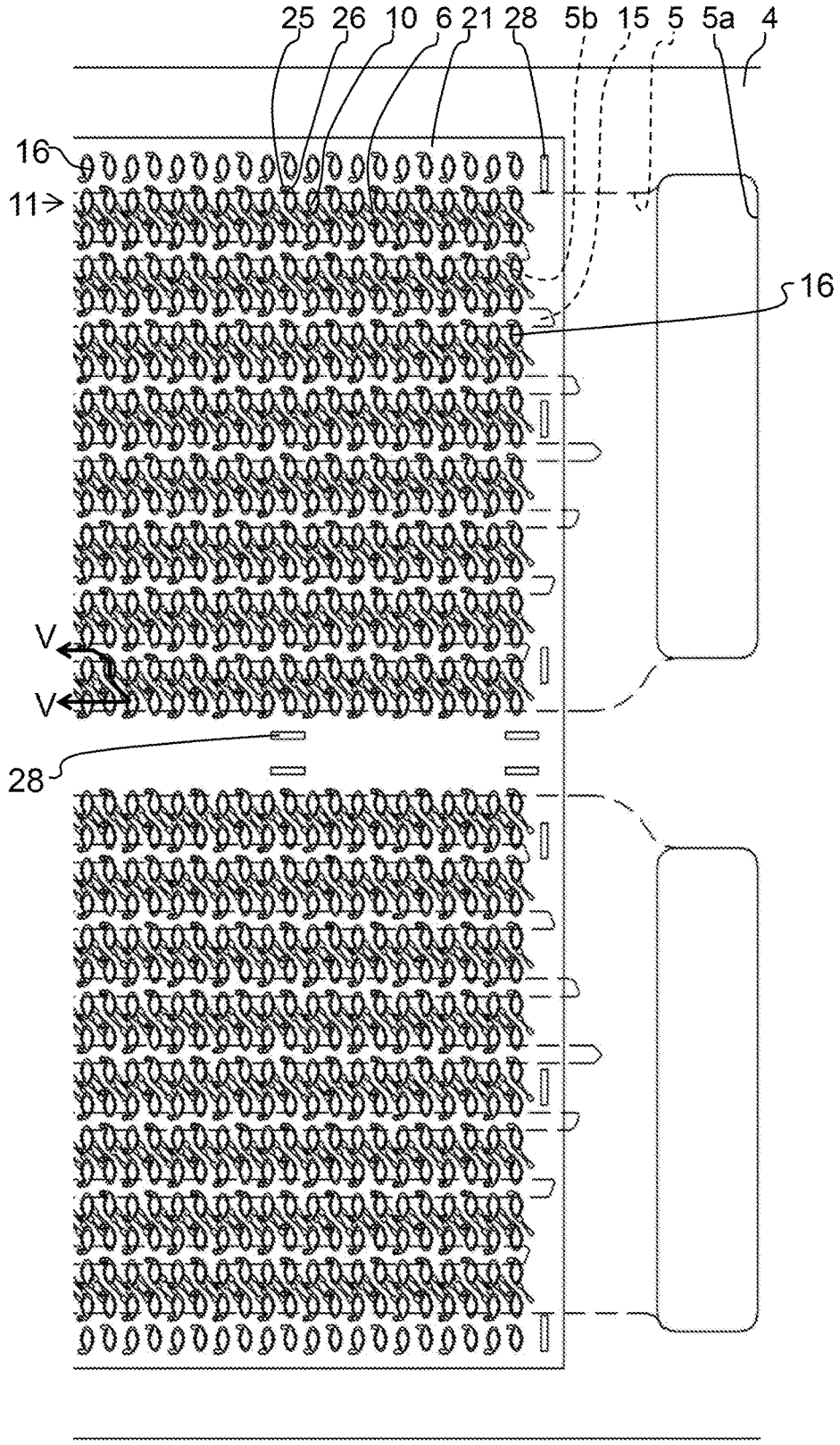
FIG. 3 is an enlarged view of the region enclosed by the dotted-chain line in FIG. 2, where some channels are omitted to simplify the description.
Figure 4:
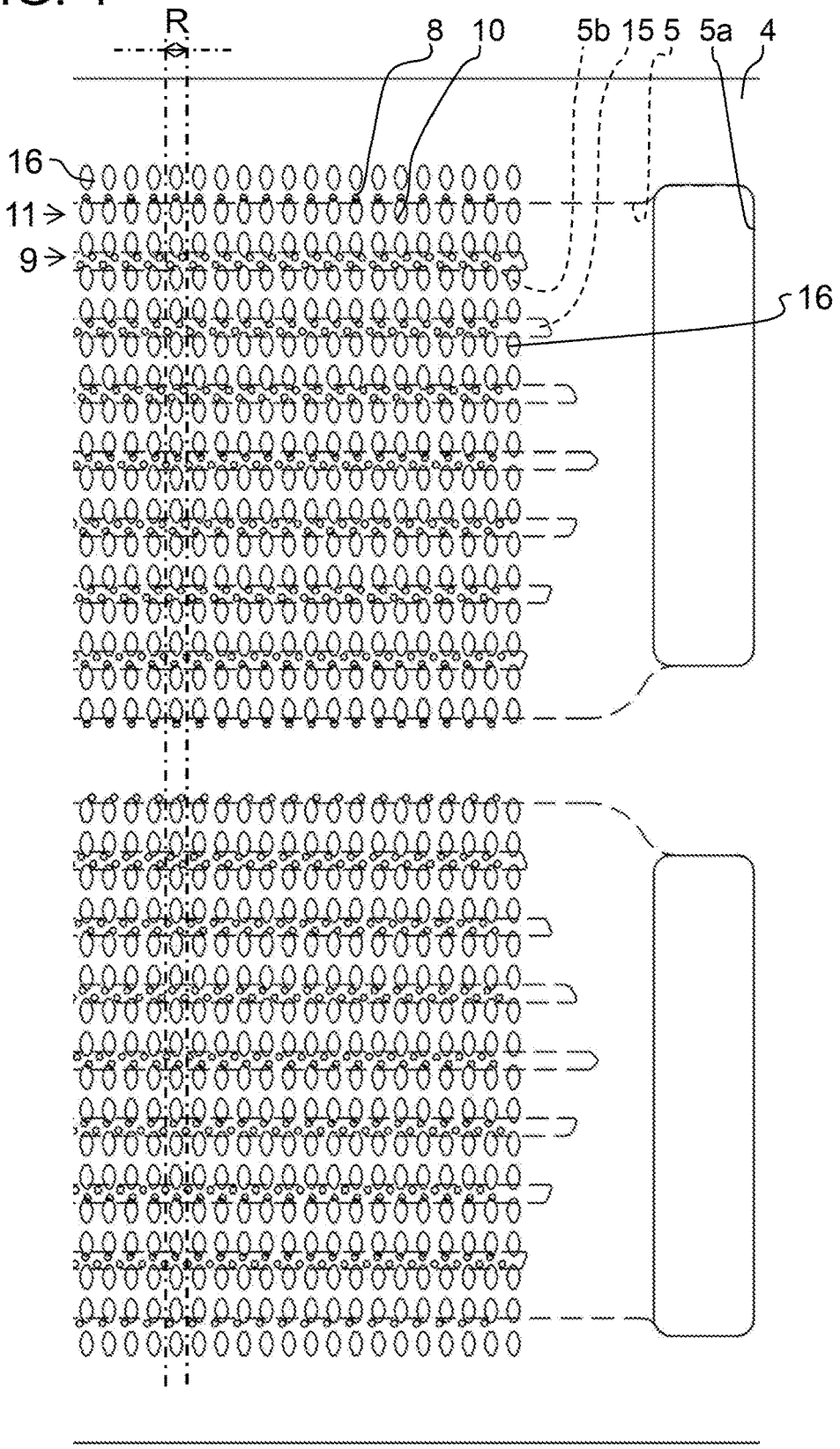
FIG. 4 is another enlarged view of the region enclosed by the dotted-chain line in FIG. 2, where some channels are omitted to simplify the description.
Figure 5A:
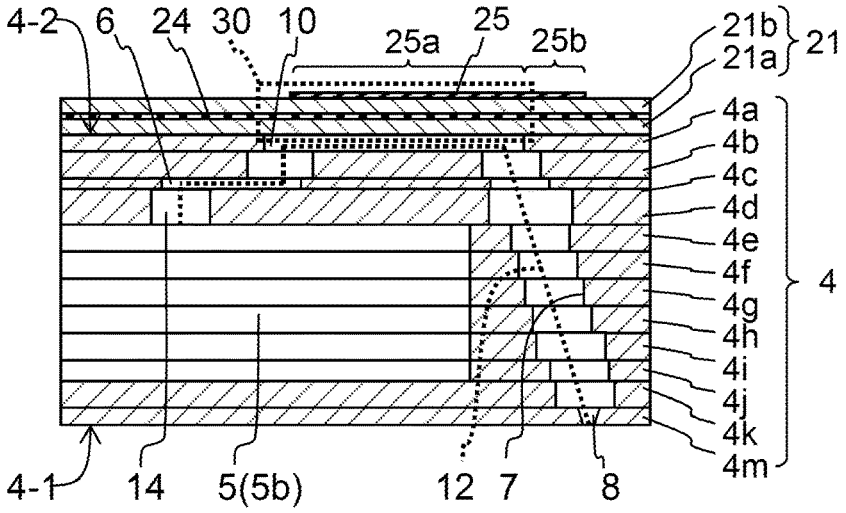
FIG. 5(*a*) is a longitudinal sectional view taken along line V-V in FIG. 3, FIG. 5(*b*) is an enlarged sectional view of a portion of FIG. 5(*a*), and FIG. 5(*c*) is a plan view of a channel illustrated in FIG. 5(*b*).
Figure 5B:
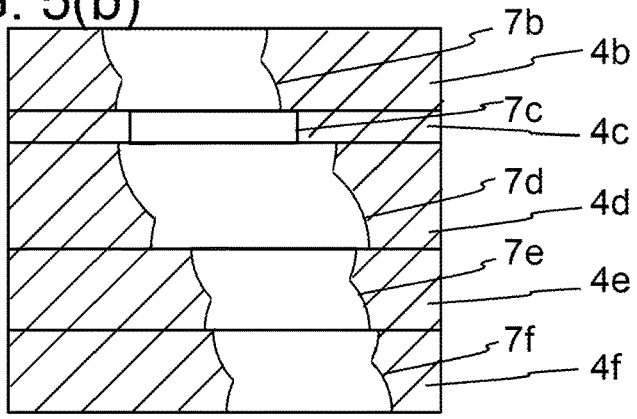
Figure 5C:
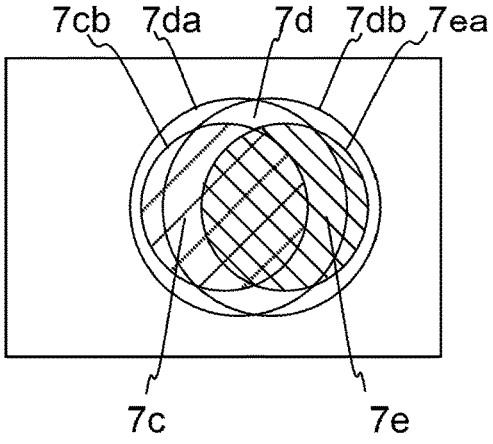

The liquid ejecting heads 2 according to the embodiment of the present invention will now be described. FIG. 2 is a plan view of a head body 2*a*, which is the main portion of each liquid ejecting head 2 illustrated in FIG. 1. FIG. 3 is an enlarged plan view of a portion of the head body 2*a* in the region enclosed by the dotted-chain line in FIG. 2. In FIG. 3, some channels are omitted to simplify the description. FIG. 4 is an enlarged plan view of the same portion as that in FIG. 3, where channels other than those omitted in FIG. 3 are omitted. FIG. 5(*a*) is a longitudinal sectional view taken along line V-V in FIG. 3. FIG. 5(*b*) is an enlarged sectional view of a portion of FIG. 5(*a*), and FIG. 5(*c*) is a plan view of a channel illustrated in FIG. 5(*b*). In FIGS. 3 and 4, compression chambers 10, restricting portions 6, ejection holes 8, etc., which are arranged below a piezoelectric actuator substrate 21 and therefore are to be drawn with broken lines, are drawn with solid lines to facilitate understanding of the drawing.

Each liquid ejecting head 2 may include a reservoir, which supplies the liquid to the head body 2*a*, and a housing in addition to the head body 2*a*. The head body 2*a* includes a channel member 4 and the piezoelectric actuator substrate 21 having displacement elements 30, which are compressing portions, formed therein.

The channel member 4 of the head body 2*a* includes manifolds S that serve as common channels, the compression chambers 10 connected to the manifolds 5, and the ejection holes 8 connected to the compression chambers 10. The compression chambers 10 open at the top surface of the channel member 4, and the top surface of the channel member 4 serves as a compression chamber surface 4-2. The top surface of the channel member 4 has openings 5*a* connected to the manifolds 5, and liquid is supplied to the manifolds 5 through the openings 5*a*.

The piezoelectric actuator substrate 21 including the displacement elements 30 is bonded to the top surface of the channel member 4 such that each displacement element 30 is arranged above the corresponding compression chamber 10. Signal transmission units 60 that supply signals to the displacement elements 30 are connected to the piezoelectric actuator substrate 21. In FIG. 2, to clearly illustrate the state in which two signal transmission units 60 are connected to the piezoelectric actuator substrate 21, the contours of the signal transmission units 60 in the regions around the portions that are connected to the piezoelectric actuator substrate 21 are shown by the dotted lines. Electrodes formed on the signal transmission units 60 and electrically connected to the piezoelectric actuator substrate 21 are arranged in a rectangular pattern at the ends of the signal transmission units 60. The two signal transmission units 60 are connected to the piezoelectric actuator substrate 21 such that the ends there of are in a central region of the piezoelectric actuator substrate 21 in the short-side direction.

The head body 2*a* includes the flat plate-shaped channel member 4 and a single piezoelectric actuator substrate 21 that is bonded to the channel member 4 and that includes the displacement elements 30. The piezoelectric actuator substrate 21 has a rectangular shape in plan view, and is arranged on the top surface of the channel member 4 such that the long sides of the rectangular shape extend in the long-side direction of the channel member 4.

Two manifolds 5 are formed in the channel member 4. The manifolds 5 have a long and narrow shape that extends from one end of the channel member 4 in the long-side direction toward the other end. Each manifold 5 has openings Sa that open at the top surface of the channel member 4 at both ends of the manifold 5.

Each manifold 5 is partitioned into sections by partition walls 15 at least in a central region thereof in the long-side direction, that is, a region in which the manifold 5 is connected to the compression chambers 10. The partition walls 15 are spaced from each other in the shortside direction. In the central region in the long-side direction, which is the region in which the manifold 5 is connected to the compression chambers 10, the partition walls 15 have the same height as that of the manifold 5 so that the manifold 5 is completely partitioned into a plurality of sub-manifolds 5*b*. Accordingly, the ejection holes 8 and channels extending from the ejection holes 8 to the compression chambers 10 can be formed so as to overlap the partition walls 15 in plan view.

The sections into which each manifold 5 is partitioned may be referred to as the sub-manifolds 5*b*. In the present embodiment, two independent manifolds 5 are provided, and each manifold 5 has the openings 5*a* at both ends thereof. Each manifold 5 is partitioned into eight sub-manifolds 5*b* by seven partition walls 15. The width of the sub-manifolds 5*b* is greater than that of the partition walls 15, so that the sub-manifolds 5*b* allow a large amount of liquid to flow therethrough.

The compression chambers 10 are arranged two dimensionally in the channel member 4. The compression chambers 10 are hollow spaces having a diamond shape with rounded corners or an elliptical shape in plan view.

Each compression chamber 10 is connected to one of the sub-manifolds 5*b* through the corresponding individual supply channel 14. Two compression chamber rows 11 are arranged one on each side of each sub-manifold 5*b* so as to extend along the sub-manifold 5*b*, each compression chamber row 11 including compression chambers 10 that are connected to the sub-manifold 5*b*. Accordingly, 16 compression chamber rows 11 are provided for each manifold 5, and 32 compression chamber rows 11 are provided in total in the head body 2*a*. In each compression chamber row 11, the compression chambers 10 are arranged with constant intervals therebetween in the long-side direction, the intervals corresponding to, for example, 37.5 dpi.

The compression chamber rows 11 have dummy compression chambers 16 at both ends thereof so that the dummy compression chambers 16 form two dummy compression chamber lines. The dummy compression chambers 16 belonging to the dummy compression chamber lines are connected to the manifolds 5, but are not connected to the ejection holes 8. Also, a dummy compression chamber row in which the dummy compression chambers 16 are linearly arranged is provided at each outer side of the 32 compression chamber rows 11 (each of the sides adjacent to the 1st compression chamber row 11 and the $32^{nd}$ compression chamber row 11). The dummy compression chambers 16 belonging to the dummy compression chamber rows are not connected to the manifolds 5 or the ejection holes 8. Owing to the dummy compression chambers 16, the compression chambers 10 disposed at the periphery have surrounding structures (rigidities) similar to the surrounding structures (rigidities) of the other compression chambers 10, so that differences in the liquid ejecting characteristics between the compression chambers 10 at the periphery and the other compression chambers 10 can be reduced. The influence of the differences between the surrounding structures is large for the compression chambers 10 that are arranged next to each other in the longitudinal direction of the channel member 4 and that are close to each other, and the influence is relatively small for the compression chambers 10 arranged next to each other in the width direction of the channel member 4. For this reason, although the compression chamber rows that are adjacent to each other in a central region of the head body 2*a* in the width direction have a large gap therebetween, no dummy compression chamber lines are provided in this region. Accordingly, the width of the head body 2*a* can be reduced.

The compression chambers 10 connected to each manifold 5 are arranged in a grid pattern having rows and columns along the outer sides of the rectangular piezoelectric actuator substrate 21. Accordingly, individual electrodes 25, which are arranged above the compression chambers 10, are evenly spaced from the outer sides of the piezoelectric actuator substrate 21. Therefore, the piezoelectric actuator substrate 21 is not easily deformed when the individual electrodes 25 are formed. If the piezoelectric actuator substrate 21 is largely deformed when the piezoelectric actuator substrate 21 and the channel member 4 are bonded together, there is a risk that the displacement elements 30 near the outer sides will receive a stress and the displacement characteristics thereof will vary. The variation in the displacement characteristics can be reduced by reducing the deformation. The influence of the deformation is further reduced since the dummy compression chamber rows including the dummy compression chambers 16 are provided on the outer side of the compression chamber rows 11 that are closest to the outer sides of the piezoelectric actuator substrate 21. The compression chambers 10 belonging to each compression chamber row 11 are arranged with constant intervals therebetween, and the individual electrodes 25 that correspond to the compression chamber rows 11 are also arranged with constant intervals therebetween. The compression chamber rows 11 are arranged with constant intervals therebetween in the short-side direction, and the rows of the individual electrodes 25 corresponding to the compression chamber rows 11 are also arranged with constant intervals therebetween in the short-side direction. Accordingly, regions in which the influence of crosstalk, in particular, is significant may be eliminated.

Although the compression chambers 10 are arranged in a grid pattern in the present embodiment, they may instead be arranged in a staggered pattern in which the compression chambers 10 of each compression chamber row 11 are disposed between the compression chambers 10 of the adjacent compression chamber row 11. In this case, the distance between the compression chambers 10 belonging to the adjacent compression chamber rows 11 can be increased, so that crosstalk can be further reduced.

Irrespective of how the compression chamber rows 11 are arranged, crosstalk can be reduced by arranging the compression chambers 10 such that, in plan view of the channel member 4, the compression chambers 10 of each compression chamber row 11 do not overlap the compression chambers 10 of the adjacent compression chamber row 11 in the long-side direction of the liquid ejecting head 2. If the distances between the compression chamber rows 11 are increased, the width of the liquid ejecting head 2 is increased accordingly. As a result, the accuracy of the angle at which the liquid ejecting head 2 is attached to the printer 1 greatly affects the printing result. When multiple liquid ejecting heads 2 are used, the accuracy of the relative positions between the liquid ejecting heads 2 also greatly affects the printing result. The influence of these accuracies on the printing result can be reduced by setting the width of the partition walls 15 smaller than that of the sub-manifolds 5*b*.

The compression chambers 10 connected to each sub-manifold 5*b* form two compression chamber rows 11, and the ejection holes 8 connected to the compression chambers 10 belonging to each compression chamber row 11 form a single ejection hole row 9. The ejection holes 8 connected to the compression chambers 10 belonging to the two compression chamber rows 11 open at different sides of the sub-manifold 5*b*. Although two ejection hole rows 9 are provided on each partition wall 15 in FIG. 4, the ejection holes 8 belonging to each ejection hole row 9 are connected to the sub-manifold 5*b* adjacent to the ejection holes 8 through the compression chambers 10. When the ejection holes 8 connected to the adjacent sub-manifolds 5*b* through the compression chamber rows 11 are arranged so as not to overlap in the long-side direction of the liquid ejecting head 2, crosstalk between the channels that connect the compression chambers 10 to the ejection holes 8 can be suppressed. Thus, crosstalk can be further reduced. When the entireties of the channels that connect the compression chambers 10 to the ejection holes 8 do not overlap in the long-side direction of the liquid ejecting head 2, crosstalk can be further reduced.

The compression chambers 10 connected to each manifold 5 form a compression chamber group. Since there are two manifolds 5, two compression chamber groups are provided. The compression chambers 10 that contribute to ejection in the compression chamber groups are arranged in the same way at positions translated from one another in the short-side direction. The compression chambers 10 are arranged along the top surface of the channel member 4 over almost the entirety of the region that faces the piezoelectric actuator substrate 21, although there are regions in which the intervals between the compression chambers 10 are somewhat large, such as the region between the compression chamber groups. In other words, the compression chamber groups including the compression chambers 10 occupy a region having substantially the same shape as that of the piezoelectric actuator substrate 21. The open side of each compression chamber 10 is covered with the piezoelectric actuator substrate 21 that is bonded to the top surface of the channel member 4.

Each compression chamber 10 has a channel extending therefrom at a corner that opposes the corner at which the individual supply channel 14 is connected to the compression chamber 10, the channel extending to the corresponding ejection hole 8 which opens in an ejection-hole surface 4-1 at the bottom of the channel member 4. The channel extends in a direction away from the compression chamber 10 in plan view. More specifically, the channel extends away from the compression chamber 10 in the diagonal direction of the compression chamber 10 while being shifted leftward or rightward relative to the diagonal direction. Accordingly, although the compression chambers 10 are arranged in a grid pattern such that the intervals there between in each compression chamber row 11 correspond to 37.5 dpi, the ejection holes 8 may be arranged with intervals corresponding to 1200 dpi over the entire region.

In other words, if the ejection holes 8 are projected onto a plane perpendicular to an imaginary straight line that is parallel to the long-side direction of the channel member 4, the 16 ejection holes 8 connected to each of the manifolds 5 in the region R enclosed by the imaginary straight lines in FIG. 4, that is, 32 ejection holes 8 in total, are arranged at constant intervals that correspond to 1200 dpi. This means that, when ink of the same color is supplied to both of the manifolds 5, an image can be formed at a resolution of 1200 dpi in the long-side direction. The 16 ejection holes 8 connected to each manifold 5 are arranged at constant intervals corresponding to 600 dpi in the region R enclosed by the imaginary straight lines in FIG. 4. Accordingly, when inks of different colors are supplied to the manifolds 5, a two-color image can be formed at a resolution of 600 dpi in the long-side direction. When two liquid ejecting heads 2 are used, a four-color image can be formed at a resolution of 600 dpi. In this case, the printing accuracy is higher than that achieved when four liquid ejecting heads capable of performing printing at 600 dpi are used, and print settings can be facilitated. The ejection holes 8 connected to the compression chambers 10 belonging to a single compression chamber line that extends in the short-side direction of the head body 2*a* cover the region R enclosed by the imaginary straight lines.

The individual electrodes 25 are formed on the top surface of the piezoelectric actuator substrate 21 at positions where the individual electrodes 25 face the corresponding compression chambers 10. Each individual electrode 25 is somewhat smaller than the corresponding compression chamber 10, and includes an individual electrode body 25*a* having a shape that is substantially similar to that of the compression chamber 10 and a lead electrode 25*b* that extends from the individual electrode body 25*a*. Similar to the compression chambers 10, the individual electrodes 25 also form individual electrode rows and individual electrode groups. Common-electrode surface electrodes 28 are also formed on the top surface of the piezoelectric actuator substrate 21. The common-electrode surface electrodes 28 are electrically connected to a common electrode 24 by through conductors (not illustrated) formed in a piezoelectric ceramic layer 21*b*.

The ejection holes 8 are located outside the regions that face the manifolds 5 arranged at the bottom side of the channel member 4. Also, the ejection holes 8 are arranged in a region facing the piezoelectric actuator substrate 21 at the bottom side of the channel member 4. The ejection holes 8 occupy a region having substantially the same shape as that of the piezoelectric actuator substrate 21 as a single group. Liquid droplets are ejected from the ejection holes 8 when the corresponding displacement elements 30 of the piezoelectric actuator substrate 21 are displaced.

The channel member 4 included in the head body 2*a* has a multilayer structure in which multiple plates are stacked together. The plates include a cavity plate 4*a*, a base plate 4*b*, an aperture (restricting portion) plate 4*c*, a supply plate 4*d*, manifold plates 4*e* to 4*j*, a cover plate 4*k*, and a nozzle plate 4*m* in that order from the top of the channel member 4. Multiple holes are formed in these plates. Each plate has a thickness of about 10 to 300 μm, so that high-precision holes can be formed. The channel member 4 has a thickness of about 500 μm to 2 mm. The plates are positioned relative to each other and stacked together so that the holes formed therein communicate with each other so as to form individual channels 12 and the manifolds 5. The head body 2*a* is configured such that the compression chambers 10 are formed in the top surface of the channel member 4, the manifolds 5 are formed in the channel member 4 at the bottom side of the channel member 4, and the ejection holes 8 are formed in the bottom surface of the channel member 4. Portions that form the individual channels 12 are arranged near each other at different locations so that the manifolds 5 are connected to the ejection holes 8 through the compression chambers 10.

The holes formed in the plates will now be described. The holes include the following first to fourth holes. The first holes are the compression chambers 10 formed in the cavity plate 4*a*. The second holes are communication holes that constitute the individual supply channels 14, each of which connects one end of the corresponding compression chamber 10 to the corresponding manifold 5. These communication holes are formed in each of the plates from the base plate 4*b* (specifically, inlets of the compression chambers 10) to the supply plate 4*d* (specifically, outlets of the manifolds 5). The individual supply channels 14 include the restricting portions 6, which are channel portions having a small cross-sectional area, in the aperture plate 4*c*.

The third holes are descenders 7 that extend from the ends of the compression chambers 10 opposite the ends connected to the individual supply channels 14 to the ejection holes 8. The descenders 7 are formed in each of the plates from the base plate 4*b* to the cover plate 4*k*.

The fourth holes are communication holes that constitute the sub-manifolds 5*b*. These communication holes are formed in the manifold plates 4*e* to 4*j*. The holes are formed in the manifold plates 4*e* to 4*j* so that partitioning portions that form the partition walls 15 remain so as to define the sub-manifolds 5*b*. The partitioning portions of the manifold plates 4*e* to 4*j* are connected to the manifold plates 4*e* to 4*j* by half-etched support portions (not illustrated).

The first to fourth communication holes are connected to each other to form the individual channels 12 extending from the inlets through which the liquid is supplied form the manifolds 5 (outlets of the manifolds 5) to the ejection holes 8. The liquid supplied to the manifolds 5 is ejected from each ejection hole 8 along the following path. First, the liquid flows upward from the corresponding manifold 5 through the individual supply channel 14 to one end of the corresponding restricting portion 6. Next, the liquid flows horizontally in the extending direction of the restricting portion 6 to the other end of the restricting portion 6. Then, the liquid flows upward toward one end of the corresponding compression chamber 10. Then, the liquid flows horizontally in the extending direction of the compression chamber 10 to the other end of the compression chamber 10. The liquid enters the corresponding descender 7 from the compression chamber 10 and flows mainly downward while moving also in the horizontal direction. Then, the liquid reaches the ejection hole 8 that opens in the bottom surface, and is ejected outward.

The piezoelectric actuator substrate 21 has a multilayer structure including two piezoelectric ceramic layers 21*a* and 21*b* composed of piezoelectric materials. Each of the piezoelectric ceramic layers 21*a* and 21*b* has a thickness of about 20 μm. The thickness of the piezoelectric actuator substrate 21 from the bottom surface of the piezoelectric ceramic layer 21*a* to the top surface of the piezoelectric ceramic layer 21*b* is about 40 μm. Each of the piezoelectric ceramic layers 21*a* and 21*b* extends over the compression chambers 10. The piezoelectric ceramic layers 21*a* and 21*b* are made of a ferroelectric ceramic material, such as a lead zirconate titanate (PZT) based, $NaNb0_3$ based, $BaTiO_3$ based, (BiNa) $NbO_3$ based, or $BiNaNb_50_{15}$ based ceramic material. The piezoelectric ceramic layer 21*a* serves as a vibration substrate, and is not necessarily composed of a piezoelectric material. The piezoelectric ceramic layer 21*a* may be replaced by, for example, a ceramic layer that is not composed of a piezoelectric material or a metal plate.

The piezoelectric actuator substrate 21 includes the common electrode 24 made of a metal material such as a AgPd-based material, and the individual electrodes 25 made of a metallic material such as a Au-based material. The common electrode 24 has a thickness of about 2 μm, and the individual electrodes 25 have a thickness of about 1 μm.

The individual electrodes 25 are formed on the top surface of the piezoelectric actuator substrate 21 at positions where the individual electrodes 25 face their respective compression chambers 10. Each individual electrode 25 is somewhat smaller than a compression chamber 10 in plan view, and includes an individual electrode body 25*a* having a shape that is substantially similar to that of the compression chamber 10 and a lead electrode 25*b* that extends from the individual electrode body 25*a*. A connecting electrode 26 is provided on an end portion of the lead electrode 25*b* that extends away from the region facing the compression chamber 10. The connecting electrode 26 is formed of a conductive resin containing conductive powder, such as silver powder, and has a thickness of about 5 to 200 μm. The connecting electrode 26 is electrically bonded to a corresponding one of the electrodes provided on the signal transmission units 60.

Drive signals are supplied to the individual electrodes 25 from the control unit 88 through the signal transmission units 60. This will be described in detail below. The drive signals are supplied at a constant period in synchronization with the conveyance speed of the print medium P.

The common electrode 24 is arranged between the piezoelectric ceramic layer 21*b* and the piezoelectric ceramic layer 21*a* so as to extend over almost the entire surfaces thereof in the planar direction. In other words, the common electrode 24 extends so as to cover all of the compression chambers 10 within the region that faces the piezoelectric actuator substrate 21. The common electrode 24 is connected to the common-electrode surface electrodes 38 by the through conductors that extend through the piezoelectric ceramic layer 21*b*. The common-electrode surface electrodes 38 are formed on the piezoelectric ceramic layer 21*b* at locations separated from the electrode groups of the individual electrodes 25. The common electrode 24 is grounded by the common-electrode surface electrodes 38, and is maintained at the ground potential. Similar to the individual electrodes 25, the common electrode surface electrodes 38 are directly or indirectly connected to the control unit 88.

Portions of the piezoelectric ceramic layer 21*b* that are interposed between the individual electrodes 25 and the common electrode 24 are polarized in the thickness direction, and serve as displacement elements 30 having a unimorph structure that are displaced when a voltage is applied to the individual electrodes 25. More specifically, when the individual electrodes 25 and the common electrode 24 are set to different potentials to apply an electric field to the piezoelectric ceramic layer 21*b* in the direction of polarization thereof, the portions to which the electric field is applied function as active portions that are deformed due to the piezoelectric effect. When the control unit 88 sets the individual electrodes 25 to a predetermined positive or negative potential relative to the potential of the common electrode 24 so that the direction of the electric field is the same as the direction of polarization, the portions of the piezoelectric ceramic layer 21*b* interposed between the electrodes (active portions) contract in the planar direction. Conversely, the piezoelectric ceramic layer 21*a*, which is an inactive layer, is not affected by the electric field, and therefore does not contract by itself but tries to restrict the deformation of the active portions. As a result, the piezoelectric ceramic layer 21*a* and the piezoelectric ceramic layer 21*b* are deformed by different amounts in the direction of polarization, so that the piezoelectric ceramic layer 21*a* is deformed so as to be convex toward the compression chambers 10 (unimorph deformation).

The liquid ejection operation will now be described. The displacement elements 30 are driven (displaced) in response to drive signals supplied to the individual electrodes 25 through, for example, a driver IC under the control of the control unit 88. The liquid ejection operation can be performed by using various types of drive signals in the present embodiment; here, a so-called pulling driving method will be described.

The individual electrodes 25 are initially set to a potential higher than that of the common electrode 24 (hereafter referred to as a high potential). The potential of each individual electrode 25 is temporarily reduced to that of the common electrode 24 (hereafter referred to as a low potential) every time an ejection request is issued, and is then returned to the high potential at a predetermined timing. Accordingly, the piezoelectric ceramic layers 21*a* and 21*b* return (start to return) to their original (flat) shape at the time when the individual electrode 25 is set to the low potential, and the volume of the corresponding compression chamber 10 increases from that in the initial state (state in which the individual and common electrodes are set to different potentials). Therefore, a negative pressure is applied to the liquid in the compression chamber 10. As a result, the liquid in the compression chamber 10 starts to vibrate at its natural vibration period. More specifically, first, the volume of the compression chamber 10 starts to increase, and the negative pressure gradually decreases. Then, the volume of the compression chamber 10 reaches a maximum volume, and the pressure decreases to approximately zero. Then, the volume of the compression chamber 10 starts to decrease, and the pressure starts to increase. The individual electrode 25 is set to the high potential substantially when the pressure reaches a maximum pressure. Accordingly, the vibration applied first and the vibration applied next are combined so that a larger pressure is applied to the liquid. The pressure is transmitted through the corresponding descender 7, so that the liquid is ejected from the corresponding ejection hole 8.

Thus, a liquid droplet can be ejected by applying a pulse driving signal to the individual electrode 25, the driving signal being set basically to the high potential and to the low potential for a predetermined period. In principle, the liquid ejection speed and the amount of ejection can be maximized by setting the pulse width to an acoustic length (AL), which is half the natural vibration period of the liquid in the compression chamber 10. The natural vibration period of the liquid in the compression chamber 10 depends greatly on the properties of the liquid and the shape of the compression chamber 10, but it depends also on the properties of the piezoelectric actuator substrate 21 and the properties of the channels connected to the compression chamber 10.

The pulse width is set to a value that is about 0.5 AL to 1.5 AL in practice because of other factors to be taken into consideration, for example, to eject the liquid in the form of a single droplet. Since the amount of ejection can be reduced by setting the pulse width to a value different from AL, the pulse width may be set to a value different from AL for the purpose of reducing the amount of ejection.

Each descender 7 is a channel that connects the corresponding compression chamber 10 to the corresponding ejection hole 8, and serves as a partial channel that constitutes a portion of a channel through which the liquid flows. The descender 7 extends through the plates 4*b* to 4*k*. The descender 7 allows the liquid to flow therethrough in the stacking direction. The liquid mainly flows from the compression chamber surface 4-2 to the ejection-hole surface 4-1. However, since the end portion of the compression chamber 10 to which the descender 7 is connected is displaced from the ejection hole 8 in a planar direction, the liquid flows while being gradually shifted in a planar direction. In other words, the descender 7 is inclined relative to the stacking direction.

Descender holes 7*b* to 7*k*, which constitute the descender 7, are somewhat displaced due to variations in the manufacturing process. When the descender 7 is inclined relative to the stacking direction, in particular, the way in which the channel characteristics are changed greatly varies depending on the relationship between the inclination direction of the descender 7 and the direction of the displacement. Unlike the case in which the inclination direction and the direction of the displacement differ by 90 degrees, when the inclination direction is the same as the direction of the displacement, the inclination and the displacement are combined such that the descender 7 includes a portion having a small cross-sectional area at an intermediate position thereof. Accordingly, the channel characteristics change significantly, and the ejection characteristics are greatly influenced.

The displacement occurs when the positions of the individual descender holes formed in the plates are displaced or when the plates are displaced when they are stacked so that the entireties of the descender holes formed in the plates are displaced. The descenders 7 included in the head body 2*a* according to the present embodiment are inclined in various directions. When the plates are displaced when they are stacked together, for example, the volume of liquid droplets may increase in the descenders 7 inclined in a certain direction and decrease in the descenders 7 inclined in another direction. Thus, there is a risk that variations in the entire head body 2*a* will be increased and the print accuracy will be reduced.

Accordingly, each descender 7, which is formed by stacking three or more plates together, is formed so as to have the following configuration. FIG. 5(*b*) illustrates an embodiment of the configuration. FIG. 5(*b*) is an enlarged longitudinal cross-sectional view of a portion of the descender 7 illustrated in FIG. 5(*a*). In FIG. 5(*a*), detailed shapes of the descender 7 formed by etching are not illustrated. FIG. 5(*c*) is a plan view illustrating the arrangement of openings of the holes that constitute the descender 7. In FIG. 5(*c*), the inner region of an opening 7*cb* at a bottom side of a first hole 7*c* (side adjacent to a second plate 4*d*) is hatched with slanted lines that extend in a direction from the upper right toward the lower left. Also, the inner region of an opening lea at a top side of a third hole 7*e* (side adjacent to the second plate 4*d*) is hatched with slanted lines that extend in a direction from the upper left toward the lower right.

Three plates that are successively stacked together are defined as a first plate 4*c*, a second plate 4*d*, and a third plate 4*e* in that order from the top. Each of the first plate 4*c*, the second plate 4*d*, and the third plate 4*e* may be a compound body obtained by bonding a plurality of elements together. Here, the first plate 4*c* is the above described aperture (restricting portion) plate 4*c*, the second plate 4*d* is the above-described supply plate 4*d*, and the third plate 4*e* is the above-described manifold plate 4*e*. The first hole 7*c*, which constitutes a portion of the descender 7, is formed in the first plate 4*c*. A second hole 7*d*, which also constitutes a portion of the descender 7, is formed in the second plate 4*d*. The third hole 7*e*, which also constitutes a portion of the descender 7, is formed in the third plate 4*e*.

In plan view, a region included in both the opening 7*cb* at the bottom side of the first hole 7*c* (side adjacent to the second plate 4*d*) and the opening 7*ea* at the top side of the third hole 7*e* (side adjacent to the second plate 4*d*) exists. In addition, a region included in the opening 7*cb* at the bottom side of the first hole 7*c* but not included in the opening 7*ea* at the top side of the third hole 7*e* also exists. In addition, a region included in the opening 7*ea* at the top side of the third hole 7*e* but not included in the opening at the bottom side 7*cb* of the first hole 7*c* exists. The opening 7*cb* at the bottom side of the first hole 7*c* and the opening 7*ea* at the top side of the third hole 7*e* are inside the second hole 7*d*. In other words, in plan view, the opening 7*cb* of the first hole 7*c* at the side adjacent to the second plate 4*d* and the opening 7*ea* of the third hole 7*e* at the side adjacent to the second plate 4*d* have a region in which they overlap and regions in which they do not overlap. In addition, in plan view, the opening 7*cb* of the first hole 7*c* at the side adjacent to the second plate 4*d* and the opening 7*ea* of the third hole 7*e* at the side adjacent to the second plate 4*d* are inside the second hole 7*d*.

The state in which the opening 7*cb* at the bottom side of the first hole 7*c* and the opening 7*ea* at the top side of the third hole 7*e* are inside the second hole 7*d* will now be described. This state means that, as illustrated in FIG. 5(*c*), in plan view, the opening 7*cb* at the bottom side of the first hole 7*c* is inside an opening 7*da* at the top side of the second hole 7*d* (side adjacent to the first plate 4*c*), and the opening 7*ea* at the top side of the third hole 7*e* is inside an opening 7*db* at the bottom side of the second hole 7*d* (side adjacent to the third plate 4*e*). In this specification, when it simply mentions "in plan view", it means that the configuration is viewed in the stacking direction of the plates 4*a* to 4*m*.

It is difficult to observe the channel member 4 that has been manufactured in practice in plan view and confirm that the opening 7*cb* at the bottom side of the first hole 7*c* is inside the opening 7*da* at the top side of the second hole 7*d* and that the opening 7*ea* at the top side of the third hole 7*e* is inside the opening 7*db* at the bottom side of the second hole 7*d*. Accordingly, to examine the channel member 4 manufactured in practice, a single longitudinal cross section of a single descender 7 may be observed, as illustrated in FIG. S(b). In this cross section, it can be confirmed that the opening 7*cb* at the bottom side of the first hole 7*c* is inside the opening 7*da* at the top side of the second hole 7*d* and that the opening 7*ea* at the top side of the third hole 7*e* is inside the opening 7*db* at the bottom side of the second hole 7*d*.

This method may also be used to confirm that, in plan view, a region included in both the opening 7*cb* at the bottom side of the first hole 7*c* and the opening 7*ea* at the top side of the third hole 7*e* exists, a region included in the opening 7*cb* at the bottom side of the first hole 7*c* but not included in the opening 7*ea* at the top side of the third hole 7*e* exists, and a region included in the opening 7*ea* at the top side of the third hole 7*e* but not included in the opening at the bottom side 7*cb* of the first hole 7*c* exists. To examine the channel member 4 manufactured in practice, a single longitudinal cross section of a single descender 7 may be observed. In this cross section, it can be confirmed that a region included in both the opening 7*cb* at the bottom side of the first hole 7*c* and the opening 7*ea* at the top side of the third hole 7*e* exists, that a region included in the opening 7*cb* at the bottom side of the first hole 7*c* but not included in the opening 7*ea* at the top side of the third hole 7*e* exists, and that a region included in the opening 7*ea* at the top side of the third hole 7*e* but not included in the opening at the bottom side 7*cb* of the first hole 7*c* exists.

When the region included in both the opening 7*cb* at the bottom side of the first hole 7*c* and the opening 7*ea* at the top side of the third hole 7*e* exists, the liquid smoothly flows from the first hole 7*c* to the third hole 7*e*. When the region included in the opening 7*cb* at the bottom side of the first hole 7*c* but not included in the opening 7*ea* at the top side of the third hole 7*e* exists, and when the region included in the opening 7*ea* at the top side of the third hole 7*e* but not included in the opening 7*cb* of the first hole 7*c* at the bottom side also exists, the first hole 7*c* and the third hole 7*e* are displaced from each other. Accordingly, when the liquid flows from the compression chamber surface 4-2 toward the ejection-hole surface 4-1, the liquid moves in the planar direction. In addition, when the opening 7*cb* at the bottom side of the first hole 7*c* and the opening 7*ea* at the top side of the third hole 7*e* are inside the second hole 7*d*, the influence caused when the holes are displaced from each other can be reduced.

The above-described arrangement is also effective for channels other than the descenders 7 through which the liquid flows in the stacking direction. In the descenders 7, variations in the pressure transmitted therethrough directly affect the ejection characteristics. Therefore, the descenders 7 have a particularly high need for the above-described arrangement. Moreover, not only does the magnitude of the pressure in the descenders 7 affect the ejection speed and the amount of ejection, but also the way in which the pressure is transmitted through the descenders 7 also affect the ejection characteristics because the direction in which the liquid is ejected from the ejection holes 8 slightly changes. Therefore, the descenders 7 have a high need for the above-described arrangement.

In plan view, the opening 7*da* at the top side of the second hole 7*d* and the opening 7*db* at the bottom side of the second hole 7*d* may be displaced from each other. In this case, compared to the case in which the opening 7*da* at the top side and the opening 7*db* at the bottom side are at the same position, the area of the opening 7*da* at the top side of the second hole 7*d* and the area of the opening 7*db* at the bottom side of the second hole 7*d* may be reduced while enabling the opening 7*cb* at the bottom side of the first hole 7*c* and the opening 7*ea* at the top side of the third hole 7*e* to be inside the second hole 7*d*. When the descender 7 includes an intermediate portion at which the cross-sectional area thereof changes, it may become difficult for the descender 7 to transmit pressure waves because, for example, the pressure waves are partially reflected at the boundary. However, when the opening 7*da* at the top side of the second hole 7*d* and the opening 7*db* at the bottom side of the second hole 7*d* are displaced from each other, the ratio of the area of the opening 7*da* at the top side of the second hole 7*d* to the area of the opening 7*cb* at the bottom side of the first hole 7*c* can be reduced. Also, the ratio of the area of the opening 7*ea* at the top side of the third hole 7*e* to the area of the opening 7*db* at the bottom side of the second hole 7*d* can be reduced. As a result, the pressure wave transmission efficiency can be increased.

The direction from the area centroid of the opening 7*da* at the top side of the second hole 7*d* to the area centroid of the opening 7*db* at the bottom side of the second hole 7*d* may be the same as the direction from the area centroid of the opening 7*cb* at the bottom side of the first hole 7*c* to the area centroid of the opening 7*ea* at the top side of the third hole 7*e*. In such a case, the pressure transmission efficiency can be increased, as described above, while enabling the liquid to flow through the descender 7 while being moved in the planar direction. Here, the state in which the directions are the same means that the angle between the above-described two directions is smaller than 90 degrees. The angle between the two directions is preferably 60 degrees or less, and more preferably, 30 degrees or less.

When the opening 7*da* at the top side of the second hole 7*d* and the opening 7*db* at the bottom side of the second hole 7*d* are displaced from each other, the opening 7*cb* at the bottom side of the first hole 7*c* may be arranged so as to be inside the opening 7*da* at the top side of the second hole 7*d* and so as to include a region that is not included in the opening 7*db* at the bottom side of the second hole 7*d*. Also, the opening 7*ea* at the top side of the third hole 7*e* may be arranged so as to be inside opening 7*db* at the bottom side of the second hole 7*d* and so as to include a region that is not included in the opening 7*da* at the top side of the second hole 7*d*. This arrangement allows the liquid to smoothly move in the planar direction while preventing a reduction in the pressure transmission efficiency.

It is difficult to observe the channel member 4 that has been manufactured in practice in plan view and confirm that the opening 7*cb* at the bottom side of the first hole 7*c* is inside the opening 7*da* at the top side of the second hole 7*d* and includes a region that is not included in the opening 7*db* at the bottom side of the second hole 7*d*, and that the opening 7*ea* at the top side of the third hole 7*e* is inside the opening 7*db* at the bottom side of the second hole 7*d* and includes a region that is not included in the opening 7*da* at the top side of the second hole 7*d*. Accordingly, to examine that the channel member 4 manufactured in practice, a single longitudinal cross section of a single descender 7 may be observed. In this cross section, it can be confirmed that the opening 7*cb* at the bottom side of the first hole 7*c* is inside the opening 7*da* at the top side of the second hole 7*d* and includes a region that is not included in the opening 7*db* at the bottom side of the second hole 7*d*, and that the opening 7*ea* at the top side of the third hole 7*e* is inside the opening 7*db* at the bottom side of the second hole 7*d* and includes a region that is not included in the opening 7*da* at the top side of the second hole 7*d*.

It is preferable that the second plate 4*d* is the thickest among the first plate 4*c*, the second plate 4*d*, and the third plate 4*e*. The second hole 7*d* in the second plate 4*d* is larger than the opening 7*cb* at the bottom side of the first hole 7*c* and the opening 7*ea* at the top side of the third hole 7*e*. Therefore, a region in which the liquid does not easily flow exists at the peripheral edge of the second hole 7*d*. When the second plate 4*d* is thin, the region in which the liquid does not easily flow at the outer periphery of the second hole 7*d* expands over a large area relative to the length of the second plate 4*d* in the direction in which the liquid flows, and accordingly the liquid easily stagnates. Therefore, the second plate 4*d* is preferably thick. In other words, preferably, a hole having a large cross-sectional area is formed in a thick plate as the second hole 7*d*. Moreover, the second plate 4*d* is preferably the thickest among the plates 4*b* to 4*k* in which the descender holes 7*b* to 7*k* are formed.

The descender 7 extends at an angle relative to the stacking direction. However, the descender 7 is formed by connecting the descender holes 7*b* to 7*k* to each other along a substantially straight line. The displacements between the plates 4*b* to 4*k* are considered to occur irrespective of the thicknesses of the plates 4*b* to 4*k*. However, the influence of the displacements differs depending on the thicknesses of the plates 4*b* to 4*k*.

In the present embodiment, the second hole 7*d* has a large cross-sectional area. However, to simplify the description, a channel member in which the second hole has the same cross-sectional area as those of the first and third holes is considered. Since the descender holes are connected to each other along a straight line, if the plates are displaced when they are stacked together, a portion of the descender is displaced from the original straight line. Since the portion of the descender is displaced from the straight line, the displacement causes a slight increase in the length of the descender. (To be more precise, the length of the descender along the center thereof increases. The center is the same as the center of the liquid flow, and therefore extends along an inclined straight line.) More specifically, as a result of the displacement, the inclination of the liquid flow increases in some of the plates, and accordingly the length by which the liquid flows (hereinafter sometimes referred to as a channel length) increases. Assume that a thin plate or a plate stacked above or below the thin plate is displaced so that the inclination of the liquid flow through the thin plate is increased. Even when the amount of displacement is constant, when the plate is thinner than the other plates, the inclination of the liquid flow through a hole formed in that plate is increased by a larger amount, and accordingly the channel length is also increased by a larger amount. In other words, the displacement has a large influence on the thin plate. To reduce the influence, a large hole is preferably formed in a plate adjacent to the thin plate as the second hole.

Accordingly, in the present embodiment, a hole is formed in the second plate 4*d* that is stacked immediately below the first plate 4*c*, which is thin, as the second hole 7*d* having a large cross-sectional area. When the reduction in the influence of the displacement is the only factor to be considered, the cross-sectional area of the first hole 7*c* in the thin first plate 4*c* is preferably increased. However, in such a case, the influence of the above described stagnation of the liquid increases. Therefore, the cross-sectional area of the second hole 7*d* in the second plate 4*d*, which is arranged below the thin first plate 4*c*, is preferably increased.

From the above-described viewpoint, it is not preferable to provide a plate that is extremely thinner than the other plates. However, in the present embodiment, the first plate 4*c* having a small thickness is provided to form channels having a high channel resistance with small variations as parts of the restricting portions 6 that connect the compression chambers 10 to the manifolds 5. The liquid ejecting head 2 according to the present embodiment the liquid by the pulling driving method. Therefore, to partially reflect the pressure waves transmitted from the compression chambers 10 toward the manifolds 5, the restricting portions 6 are required to have a high channel resistance. Since the way in which the pressure waves are reflected varies depending on the channel resistance, variations in the channel resistance are preferably small. When channels through which the liquid flows in the stacking direction are to be structured such that the channels have a high channel resistance, the opening area is reduced. Therefore, it is difficult to reduce the variations since the influence of variations in the opening area caused when the channels are formed and the displacements cased in the stacking process is large. When channels through which the liquid flows in a horizontal direction are to be structured such that the channels have a high channel resistance, the width of the channels (to be more precise, the width of the openings in the plate) may be reduced. In such a case, variations in the opening width caused when the channels are formed are increased, and it is therefore difficult to form channels having an extremely small width. However, unless the cross-sectional area of the restricting portions 6 in the direction in which the liquid flows is reduced, the length of the restricting portions 6 required to obtain the necessary channel resistance increases and the size of the channel member 4 increases accordingly. For the above described reason, preferably, parts of the restricting portions 6 having a high channel resistance are formed of channels that extend in a horizontal direction in a single plate, and the thickness of the plate is reduced. Accordingly, in the channel member 4 according to the present embodiment, the thickness of the first plate 4*c* is set to be as small as 25 μm, and, to reduce the influence of the small thickness, the large second hole 7*d* is formed in the second plate 4*d*, and the thickness of the second plate 4*d* is set to be as large as 150 ~m. The thickness of the other plates 4*b* and 4*e* to 4*k* is 100 μm. To sum up, the second hole 7*d* having a large cross-sectional area is preferably formed in the second plate 4*d* stacked between the first plate 4*c* and the third plate 4*e* having different thicknesses. Accordingly, the influence of the displacement of the thinner one of the first plate 4*c* and the third plate 4*e* can be reduced.

The above-described configuration is particularly advantageous when, in plan view, the descender hole 7*b* formed in the plate 4*b* stacked above the first plate 4*c* is at a side of the first hole 7*c* opposite to the side at which the second hole 7*d* is disposed. In addition, the above described configuration is particularly advantageous when, in plan view, the descender hole 7*f* formed in the plate 4*f* stacked below the third plate 4*e* is at a side of the third hole 7*e* opposite to the side at which the second hole 7*d* is disposed.

In the present embodiment, the second hole 7*d* has a circular shape in cross section perpendicular to the stacking direction. However, the second hole 7*d* may instead have an oval shape. The oval shape is not limited to an elliptical shape in a mathematical sense, but also includes a shape obtained by elongating a circle in a certain direction. When the opening 7*cb* at the bottom side of the first hole 7*c* and the opening 7*ea* at the top side of the third hole 7*e* are separated from each other in plan view, the shape of the second hole 7*d* in cross section perpendicular to the stacking direction may be an oval shape that is long in a direction connecting the area centroid of the opening 7*cb* at the bottom side of the first hole 7*c* and the area centroid of the opening 7*ea* at the top side of the third hole 7*e*. In such a case, the opening 7*cb* at the bottom side of the first hole 7*c* and the opening 7*ea* at the top side of the third hole 7*e* may be connected by the second hole 7*d* without increasing the width in a direction perpendicular to the direction connecting the area centroid of the opening 7*cb* at the bottom side of the first hole 7*c* and the area centroid of the opening 7*ea* at the top side of the third hole 7*e*. In other words, preferably, the second hole 7*d* has an oval shape in cross section perpendicular to the stacking direction, and, in plan view of the channel member 4, the second hole 7*d* is long in the direction connecting the area centroid of the opening 7*cb* of the first hole 7*c* at the side adjacent to the second plate 4*d* and the area centroid of the opening 7*ea* of the third hole 7*e* at the side adjacent to the second plate 4*d*.

Figure 6:
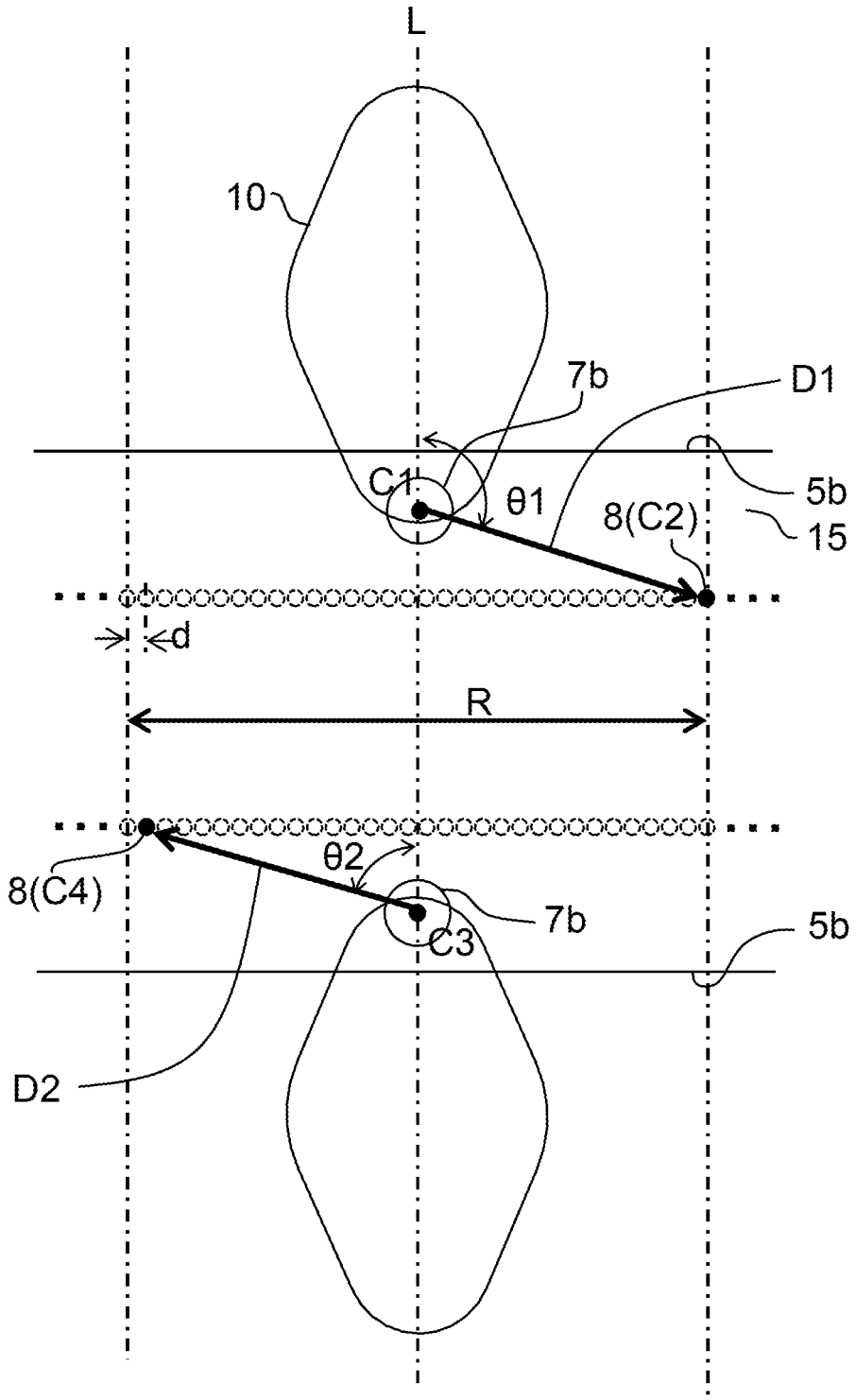
FIG. 6 is a schematic enlarged plan view of a portion of a head body.

The inclination of the direction in which the holes from the first hole 7*c* to the third hole 7*e* are arranged will be further described. FIG. 6 is a schematic plan view illustrating the relationship between the compression chambers 10 and the ejection holes 8. FIG. 6 illustrates two compression chambers 10 that are connected to different sub-manifolds Sb and that are adjacent to each other, and the ejection holes 8 that are connected to the respective compression chambers 10. The two compression chambers 10 belong to the same compression chamber line, and are arranged along an imaginary straight line L that extends in the short-side direction of the head body 2*a*.

The ejection holes 8 connected to the compression chambers 10 belonging to the compression chamber line that extends along the imaginary straight line L are in a region indicated by R in FIG. 6 in the longitudinal direction of the channel member 4. The positions of the 32 ejection holes 8 connected to the 32 compression chambers 10 belonging to the compression chamber line that extends along the imaginary straight line L in the longitudinal direction of the channel member 4 are indicated by the dashed circles. The positions of the two ejection holes 8 connected to the two compression chambers illustrated in FIG. 6 are indicated by the filled circles. The intervals between the ejection holes 8 are constant (d [~m] in FIG. 6).

The descender holes 7*b* to 7*k* that constitute each descender 7 are arranged along the straight line that connects the opening at the top side of the descender hole 7*b* to the corresponding ejection hole 8. For simplicity, the descender holes 7*c* to 7*k* are not illustrated in FIG. 6, and only the openings at the top sides of the descender holes 7*b*, the ejection holes 8, and the straight lines that connect the openings at the top sides of the descender holes 7*b* to the ejection holes 8 are illustrated.

In FIG. 6, C1 indicates the area centroid of the opening at the top side of the descender hole 7*b* of the descender 7 connected to the compression chamber 10 drawn in the upper part, and C2 indicates the position of the ejection hole 8 connected to the compression chamber 10. The direction from C1 to C2 is the same as the direction from the area centroid of the opening 7*cb* at the bottom side of the first hole 7*c* to the area centroid of the opening lea at the top side of the third hole 7*e* in this descender 7.

In FIG. 6, C3 indicates the area centroid of the opening at the top side of the descender hole 7*b* of the descender 7 connected to the compression chamber 10 drawn in the lower part, and C4 indicates the position of the ejection hole 8 connected to the compression chamber 10. The direction from C3 to C4 is the same as the direction from the area centroid of the opening 7*cb* at the bottom side of the first hole 7*c* to the area centroid of the opening 7*ea* at the top side of the third hole 7*e* in this descender 7.

The angle between a first direction D1, which is the direction from C1 to C2, and a second direction D2, which is the direction from C3 to C4, is the sum of the angle 81 between the imaginary straight line L and the first direction D1 and the angle 82 between the imaginary straight line L and the second direction D2, and is only slightly smaller than 180 degrees. This shows that the directions of the inclinations of the two descenders 7 are substantially opposite. In other words, the position of the opening 7*ea* at the top side of the third hole 7*e* relative to the opening 7*cb* at the bottom side of the first hole 7*c* in one of the two descenders 7 is substantially opposite to that in the other descender 7.

In this arrangement, when the displacements between the first plate 4*c*, the second plate 4*d*, and the third plate 4*e* occur in the direction from C1 to C2 or in the direction opposite thereto, the amount of ejection and the ejection speed differ between the two descenders 7. For example, the amount of ejection may increase in one descender 7 and decrease in the other descender 7.

When the maximum angle between the first direction D1 and the second direction D2 in the head body 2*a* is greater than 90 degrees, the ejection characteristics greatly differ between the descenders 7. Therefore, in such a head body 2*a*, the above-described configuration of the first hole 7*c*, the second hole 7*d*, and the first hole 7*e* is effective. The configuration is particularly effective when the maximum angle between the first direction D1 and the second direction D2 is 135 degrees or more.

REFERENCE SIGNS LIST

1 color inkjet printer
2 liquid ejecting head
2*a* head body
4 channel member
4*a* to 4*m* plates (of channel member)
4*c* first plate
4*d* second plate
4*e* third plate
4-1 ejection-hole surface
4-2 compression chamber surface
5 manifold
5*a* opening (of manifold)
5*b* sub-manifold
6 restricting portion
7 descender
7*c* first hole (descender hole)
7*cb* opening at bottom side (side adjacent to second plate) of first hole
7*d* second hole (descender hole)
7*da* opening at top side (side adjacent to first plate) of first hole
7*db* opening at bottom side (side adjacent to third plate) of second hole
7*e* third hole (descender hole)
7*ea* opening at top side (side adjacent to second plate) of third hole
7*b*, 7*g* descender hole
8 ejection hole
9 ejection hole row
10 compression chamber
11 compression chamber row
12 individual channel
14 individual supply channel
15 partition
16 dummy compression chamber
21 piezoelectric actuator substrate
21*a* piezoelectric ceramic layer (vibration substrate)
21*b* piezoelectric ceramic layer
24 common electrode
25 individual electrode
25*a* individual electrode body
25*b* lead electrode
26 connecting electrode
2B common-electrode surface electrode
30 displacement element
60 signal transmission
70 head mounting frame
72 head group
BOa feed roller
BOb take-up roller
B2A guide roller
2B conveying roller
B control unit
P print sheet unit

What is claimed is:

1. A channel member for a liquid ejecting head comprising:

a first plate including a first channel hole, a second plate including a second channel hole and stacked on the first plate, and a third plate including a third channel hole and stacked on the second plate, wherein in a cross sectional view of the channel member, the first channel hole having a first region and a second region, at an interface between the first plate and the second plate, the first region overlapping the third channel hole at an interface between the second plate and the third plate, the second region not overlapping the third channel hole at the interface between the second plate and the third plate, the third channel hole having a third region and a fourth region, at the interface between the second plate and the third plate, the third region overlapping the first channel hole at the interface between the first plate and the second plate, the fourth region not overlapping the first channel hole at the interface between the first plate and the second plate, the first channel hole is smaller than the second channel hole at the interface between the first plate and the second plate, and the first channel hole is completely overlapped by the second channel hole at the interface between the first plate and the second plate, and the third channel hole is smaller than the second channel hole at the interface between the second plate and the third plate, and the third channel hole is completely overlapped by the second channel hole at the interface between the second plate and the third plate.

2. The channel member for a liquid ejecting head according to claim 1, wherein the second plate is thickest among the first plate, the second plate, and the third plate.

3. The channel member for a liquid ejecting head according to claim 1, wherein a thickness of first plate differs from a thickness of the third plate.

* * * * *